United States Patent [19]

Begley

[11] Patent Number: 4,801,029

[45] Date of Patent: Jan. 31, 1989

[54] TAMPER EVIDENT CAP

[75] Inventor: Douglas G. Begley, Palatine, Ill.

[73] Assignee: Continental White Cap, Inc., Northbrook, Ill.

[21] Appl. No.: 153,922

[22] Filed: Feb. 9, 1988

[51] Int. Cl.[4] ..... B65D 41/34

[52] U.S. Cl. ..... 215/250; 215/252; 264/328.12

[58] Field of Search ..... 215/250, 252, 251, 253; 264/328.12

[56] References Cited

U.S. PATENT DOCUMENTS

| | | | |
|---|---|---|---|
| 3,504,818 | 4/1970 | Crisci | 215/252 |
| 3,747,793 | 7/1973 | Wassilieff | 215/250 |
| 3,874,540 | 4/1975 | Hidding | 215/252 |
| 3,967,745 | 7/1976 | Julian | 215/252 X |
| 4,197,955 | 4/1980 | Luenser | 215/252 |
| 4,378,894 | 4/1983 | Willis et al. | 215/252 |
| 4,505,401 | 3/1985 | Berglund | 215/252 |
| 4,529,096 | 7/1985 | Chartier | 215/252 |
| 4,573,601 | 3/1986 | Berglund | 215/252 |
| 4,625,875 | 12/1986 | Carr et al. | 215/252 X |

*Primary Examiner*—Donald F. Norton

*Attorney, Agent, or Firm*—Charles E. Brown; Paul Shapiro; Charles A. Brown

[57] ABSTRACT

This relates to a tamper indicating cap which includes a conventional closure of the threaded type. The closure is provided with an injection molded member which includes an inner ring that overlies and is bonded to an end panel of the conventional closure and an outer ring which is telescoped over and extends beyond a skirt of the conventional closure. The inner ring is joined to the outer ring by a first set of breakable bridges and a second set of bridges in the form of diagonal links. When the outer ring is turned in a cap removing direction, the two rings move relative to one another sufficiently to cause rupture of the first set of ribs to indicate tampering. The diagonal links then transmit cap removal torque to the center ring and from the center ring to the shell of the conventional closure.

15 Claims, 1 Drawing Sheet

TAMPER EVIDENT CAP

This invention relates in general to new and useful improvements in tamper evident caps, and more particularly to a separately formed member which is attached to a conventional threaded closure so as to restrict access to the closure.

In the past, closures of various types having tamper evident means have been provided. However, these prior art tamper evident closures in general require either an element to be left on the container or an element to be completely removed from the closure. In accordance with this invention, there is provided tamper evident means wherein while rupture of bridges does occur to indicate tampering, no element remains on an open container nor is there any element removed from the closure per se.

In accordance with this invention, there is provided a conventional screw threaded closure to which there is attached in telescoped relation a tamper indicating member. The tamper indicating member includes an inner ring which is bonded to an end panel of the closure and an outer ring which is telescoped over a skirt of the closure. The two rings are joined together by a first set of bridges which are breakable and a second set of bridges which function to transmit torque between the outer ring and the inner ring. When the first set of bridges break, they remain secured to the rings and the second set of bridges serve to hold the rings together and transmit closure removing torque from the outer ring to the inner ring.

An important feature of the tamper evident cap is that while the cap will reveal attempted entry into an associated container, it does so without creating loose parts such as a pull handle or a ring left on the container which requires sorting or disassembly for recycling. The tamper evident cap is a complete unit.

With the above and other objects in view that will hereinafter appear, the nature of the invention will be more clearly understood by reference to the following detailed description, the appended claims, and the several views illustrated in the accompanying drawings.

Figures 1, 2, 3, 4, 5, 6:
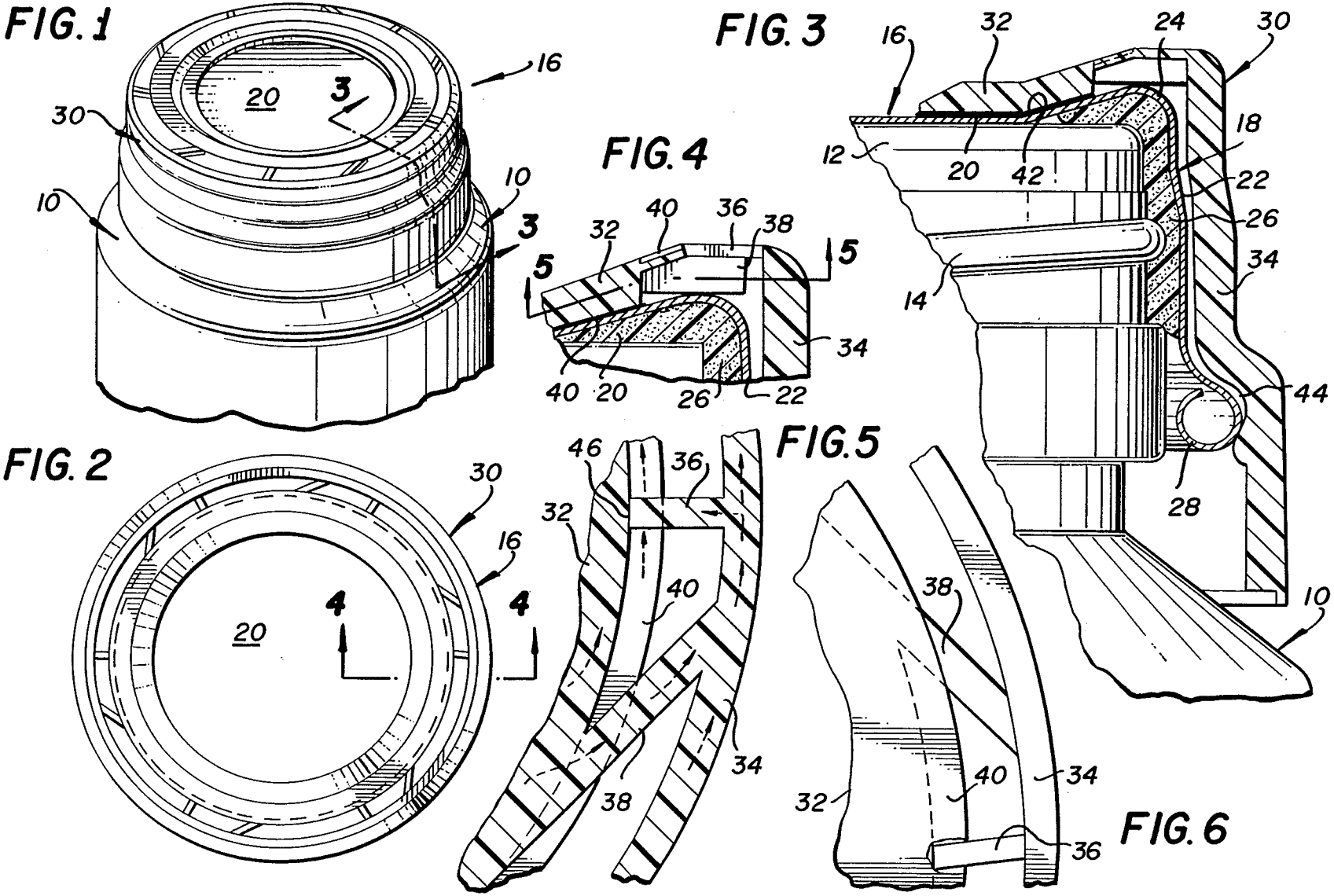
FIG. 1 is a top perspective view of a container which is closed by a tamper evident cap formed in accordance with this invention.
FIG. 2 is a top plan view of the tamper evident cap per se.
FIG. 3 is an enlarged fragmentary vertical sectional view taken generally along the line 3—3 of FIG. 1 and shows specifically the details of construction of the cap and its relationship to a conventional container.
FIG. 4 is an enlarged fragmentary vertical sectional view taken generally along the line 4—4 of FIG. 2 and shows more specifically the constructional details of the tamper evident cap.
FIG. 5 is a horizontal sectional view taken generally along the line 5—5 of FIG. 4 and shows the relationship between the inner and outer rings and bridges extending therebetween.
FIG. 6 is an enlarged fragmentary plan view of the tamper indicating member per se showing one of the bridges of the first set of bridges broken as would occur when an opening torque is applied to the outer ring.

Referring now to the drawings in detail, it will be seen that there is illustrated an upper part of a conventional container 10 having a neck finish 12 including a screw thread 14. The container 10 is closed by means of a conventional closure generally identified by the numeral 16. The closure 16 includes a shell, generally identified by the numeral 18 with the shell including an end panel 20 and a depending skirt 22. The end panel 20 and the skirt 22 are connected at an upper corner 24. The skirt 22 and the corner 24 are lined with a conventional combined thread forming and sealing compound 26. The skirt 22 may terminate in a curl 28.

In accordance with this invention, there is provided a separate tamper indicating member, generally identified by the numeral 30. The member 30 includes an inner ring 32 and an outer ring 34 which are joined together by two sets of webs with the first set of webs being in the form of breakable bridges 36 which extend radially, generally in the plane of the inner ring 32 between the rings 32, 34. The second set of webs are in the form of bridges or diagonal links 38 which extend inwardly from the outer ring 34 to the inner ring 32 in a torque transmitting direction.

The member 30 is formed by molding, preferably injection molding, and there is a peripheral ring of flash 40 extending radially outwardly from the upper peripheral edge portion of the inner ring 32, as is best shown in FIG. 4. The flash is integrally bonded to the bridges 36 which are relatively thin, as is also shown in FIG. 4. On the other hand, the diagonal links or bridges 38 are relatively thick as is also shown in FIG. 4.

The inner ring 32 is seated on the end panel 20 and is secured thereto by means of a layer of adhesive 42. If desired, the outer ring 34 may be configurated to include a radially inwardly opening groove 44 which receives in interlocking relation the curl 28.

The member 30 may be readily joined to the closure 16 by applying the adhesive 42 and then snapping the member 30 into position on the closure 16 with the closure being held in place by the interlock between the curl 28 and the groove 44.

It is to be understood that while the inner ring 32 is anchored to the closure 16, the outer ring 34 is free to rotate on the closure. Furthermore, the outer ring 34 is of a length to completely seal the closure 16 so as to prevent direct contact with and rotation of the closure 16 relative to the container 10.

Should there be any turning of the member 30 in a cap removing direction, if the rotation and torque applied is sufficient, before the inner ring 32 is turned, the thin rupturable bridges 36 will rupture as is shown in FIG. 6. Even if the application of torque to the outer ring 30 is ceased at this time, the bridges 36 will remain broken and since this includes the tearing apart of the flash 40, the breakage will be quite evident as is clearly shown in FIG. 6.

Once it is decided to open the container, the diagonal links or bridges 38 will receive in compressive relation the torque from the outer ring 34 and direct the same to the inner ring 32, applying sufficient force to the closure 16 to effect the rotation thereof relative to the container 10 and the removal of the tamper evident cap 16. It will be seen that the entire unit is removed from the container so that there is no part remaining on the container. Furthermore, it will be seen that all parts of the member 30 remain attached so that there are no loose parts.

At this time it is particularly pointed out here that the inner ring 32 can be made either as a solid disc reaching across the entire end panel 20 or it can be made in a ring having a central hole to allow normal function of a button should the end panel be provided with such a button. The adhesive 42 is a single-use adhesive and the inner ring cannot be separated from the metal shell without damage and the use of heat to aid separation would only damage the plastic parts.

It is to be particularly understood that the diagonal links 38, while they do transmit torque from the outer ring 34 to the inner ring 32, initially allow sufficient relative rotation between the two rings so as to apply a breaking force to the breakable bridges 36.

The member 30 is preferably formed by injection molding with the plastic being introduced to the inner ring area first, filling it and rushing through the thicker diagonal links 38 to fill the outer ring. Once this is done, the plastic would then enter the breakable bridge sections of the mold and head back towards the inner ring area where it would meet a cold wall of plastic. The flash rim 40 might also fill out at this time. In this way a weld line 46 is produced at the inside ends of the breakable bridges 36. The use of a thin protective flange in the form of the flash 40 over the weld line 46 magnifies damage and also restricts accress by tools or fixtures to twist the closure open. The flash 40 helps to prevent any type of grip being attained on either the inner ring or the diagonal link area heading into the inner ring.

The plastic material flow is shown by arrows in FIG. 5.

Although only a preferred embodiment of the tamper evident cap has been specifically illustrated and described herein, it is to be understood that minor variations may be made therein without departing from the spirit and scope of the invention as defined by the appended claims.

I claim:

1. A tamper evident cap comprising a screw threaded closure including an end panel and a skirt, an inner ring fixedly secured to said end panel and an outer ring telescoped over said skirt and being rotatable relative to said skirt, first and second sets of bridges extending between said inner and outer rings, said first set of bridges being rupturable in response to application of cap removing torque to said outer ring, and said second set of bridges forming torque transmitting means for effecting rotation of said inner ring and said closure after breakage of said first set of bridges.

2. A tamper evident cap according to claim 1 wherein all of said bridges remain connected to said rings after turning of said cap to an open position.

3. A tamper evident cap according to claim 1 wherein said bridges of said first set extend radially between said rings and said bridges of said second set extend digonally between said rings.

4. A tamper evident cap according to claim 1 wherein said bridges of said first set extend radially between said rings and said bridges of said second set extend diagonally between said rings in the general direction of cap removal rotation of said outer ring.

5. A tamper evident cap according to claim 1 wherein said bridges of said first set extend radially between said rings and said bridges of said second set extend diagonally between said rings in the general direction of cap removal rotation of said outer ring in compressive relation towards said inner ring and form torque transmitting links.

6. A tamper evident cap according to claim 1 wherein said bridges of said second set extend diagonally between said rings.

7. A tamper evident cap according to claim 1 wherein said bridges of said second set extend diagonally between said rings in the general direction of cap removal rotation of said outer ring.

8. A tamper evident cap according to claim 1 wherein said bridges of said second set extend diagonally between said rings in the general direction of cap removal rotation of said outer ring in compressive relation towards said inner ring and form torque transmitting links.

9. A tamper evident cap according to claim 1 wherein said screw threaded closure is a conventional closure, and said rings and bridges are part of a separately formed member having only said inner ring secured to said closure.

10. A tamper evident cap according to claim 1 wherein said rings and said bridges are integral parts of a molded member.

11. A tamper evident cap according to claim 1 wherein said inner ring has a radially outwardly directed peripheral flash overlying and bonded to said bridges of said first set.

12. A tamper evident cap according to claim 1 wherein said outer ring has an axial interlock with said skirt.

13. A tamper evident cap according to claim 1 wherein said outer ring has an axial interlock with said skirt, said interlock being in the form of a curl along a lower edge of said skirt and a cooperating internal groove in said outer ring.

14. A tamper evident cap according to claim 1 wherein said rings and bridges are formed by injection molding and there is a weakened bond between each bridge of said first set and said inner ring due to a flow of plastic material from said outer ring to form said first set of bridges and the plastic of each bridge flowing against an already formed inner ring.

15. A method of injection molding a tamper indicating plastic member including spaced outer and inner rings joined at intervals by a first set of thin bridges and a second set of thick bridges, said method comprising introducing plastic material to said inner ring to first form said inner ring, then flowing the plastic material through said thick bridges to form said outer ring, and then flowing plastic material from said outer ring back towards said inner ring to form said thin bridges, the plastic material forming the thin bridges contacting the partially cold surface of said inner ring to form a weakened weld bond where rupture of said thin bridges will occur to provide evidence of tampering.

* * * * *